United States Patent [19]

Kenney

[11] Patent Number: 4,532,726

[45] Date of Patent: Aug. 6, 1985

[54] TICKET HOLDERS FOR SHELVING

[76] Inventor: Richard E. H. Kenney, 126 Furnival Rd., Toronto, Ontario, Canada, M4B 1W8

[21] Appl. No.: 649,604

[22] Filed: Sep. 12, 1984

[30] Foreign Application Priority Data

Feb. 20, 1984 [GB] United Kingdom ..... 8404404

[51] Int. Cl.[3] ..... G09F 3/18

[52] U.S. Cl. ..... 40/16.4; 40/10 R; 40/16; 40/16.2

[58] Field of Search ..... 40/16.4, 16.2, 16, 10 R

[56] References Cited

U.S. PATENT DOCUMENTS

| | | | |
|---|---|---|---|
| 2,895,241 | 7/1959 | Ferdinand et al. | 40/16.4 |
| 2,936,904 | 5/1960 | Streater | 40/16 |
| 4,334,372 | 6/1982 | Colmar | 40/16.2 |
| 4,426,797 | 1/1984 | Burkemper et al. | 40/16.4 |

FOREIGN PATENT DOCUMENTS

| | | | |
|---|---|---|---|
| 381072 | 10/1964 | Switzerland | 40/10 R |
| 408628 | 9/1966 | Switzerland | 40/16.4 |

*Primary Examiner*—Robert Peshock
*Assistant Examiner*—Cary E. Stone
*Attorney, Agent, or Firm*—Emory L. Groff, Jr.

[57] ABSTRACT

A ticket holder for shelving such as in supermarkets, comprises a front support surface with parallel channels to engage and retain the edges of a price ticket. The rear surface has an integral formation defining a hook which has a first pair of parallel edges which engage with a shelf rail, the edge having an opposed edge which with an edge of the surface defines a further pair of parallel edges to engage the ticket rail at a different angle. By inverting the holder and engaging the edges a third angular position of the surface is obtained.

4 Claims, 7 Drawing Figures

TICKET HOLDERS FOR SHELVING

Figure 1:
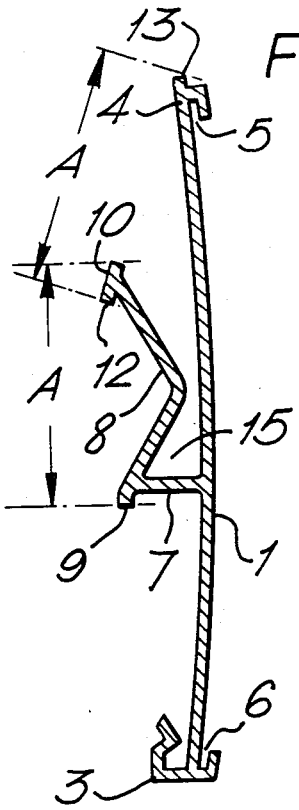

This invention relates to ticket holders for shelving such as the kind used for merchandise marketing wherein the edge of the shelf includes a rail to receive a ticket holder into which holder merchandise information printed onto sheet members, such as cards carrying pricing, may be inserted.

With known ticket holders the information presented on the face thereof by the cards becomes difficult to view when placed on shelves which are above or below eye-level, this being due to the generally constant angle vertical face surface presented by the ticket holder. Attempts have been made to avoid this difficulty in prior-art constructions by hinging the face of the ticket holder relative to the part forming the connection with the shelf rail. Such a construction is however expensive to manufacture because of the two part construction and not altogether satisfactory due to the fact that the holder is easily displaced accidentally especially at the lower heights.

It is one object of this invention to provide a ticket holder for engagement with a shelf edge rail having opposed parallel channels wherein the holder may adopt a plurality of angular positions to assist viewing, for example when on upper or lower shelves.

It is another object of this invention to provide a holder which is a one piece extrusion or moulding.

According to this invention there is provided a ticket holder for shelving comprising a front support surface with parallel channels along opposed sides to receive a panel carrying pricing or other information, the rear of the holder having means for engagement with a ticket rail said means comprising integral formations defining a first pair of spaced parallel edges which can be relatively flexed to engage one within each of opposed parallel channels of a ticket rail, one of said edges being spaced with respect to a further formation at a side of the support surface so as to define therewith a further pair of spaced parallel edges which can be relatively flexed to engage the channels of a ticket rail, the support surface lying in one of two angled positions according to which pair of edges is engaged with the ticket rail.

Preferably the engagement means comprises a hook shaped projection defining the first pair of edges, the hook lying adjacent the rear surface of the holder to form a clip.

In a preferred embodiment the holder has a support surface with a front face thereof having parallel facing channels along opposed longitudinal sides the rear face having an integral longitudinal extension having a first part lying adjacent and converging with the rear surface of the holder to define a channel, and a second part extending therefrom and diverging from the rear surface to form an entrance slot to the channel, the said extension having a first pair of spaced parallel longitudinally extending edges of a dimension therebetween to engage said shelf rail, the extension having a further edge, which in conjunction with an edge of the holder defines a second pair of spaced longitudinally extending parallel edges of a dimension therebetween to engage said shelf ticket rail.

Figure 2:
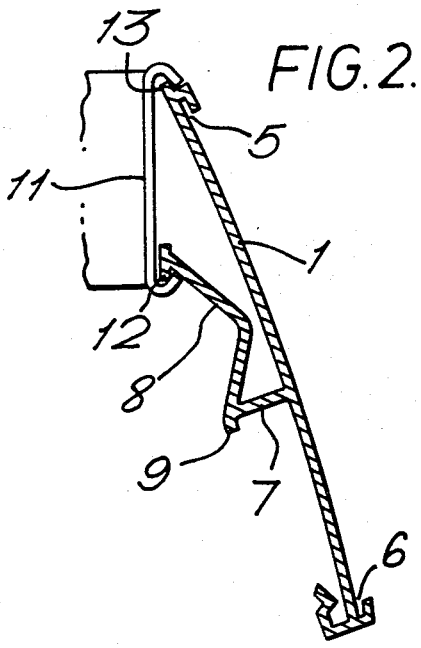
Figure 3:
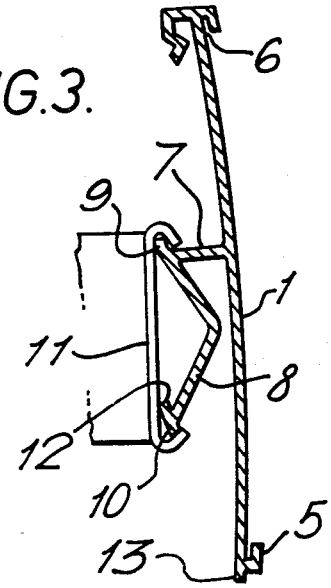
Figure 4:
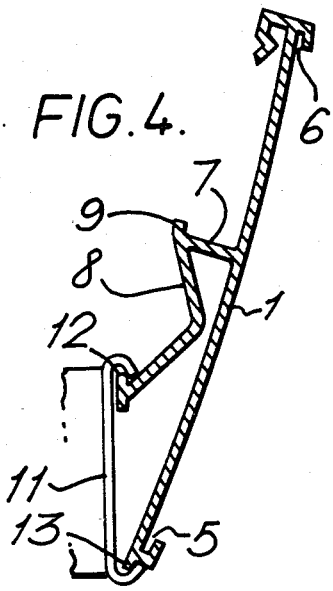
Figure 5:
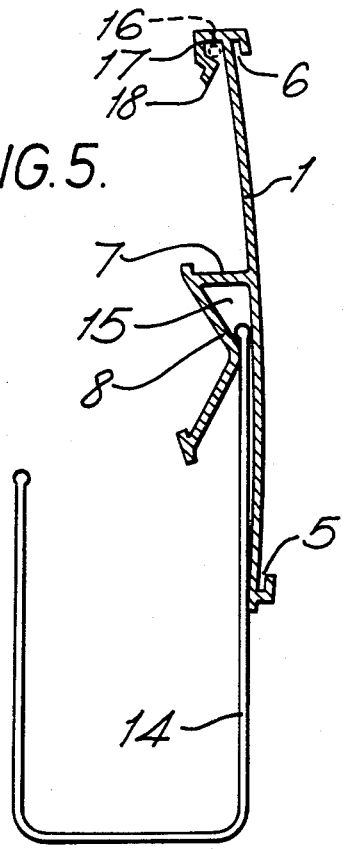
Figure 6:
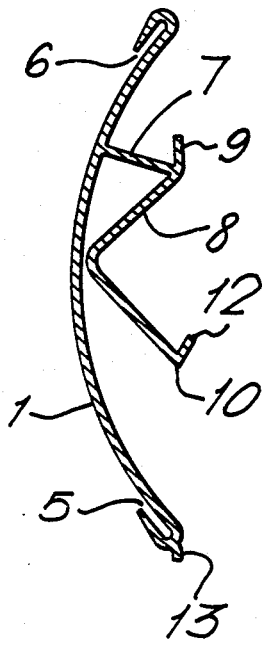
Figure 7:
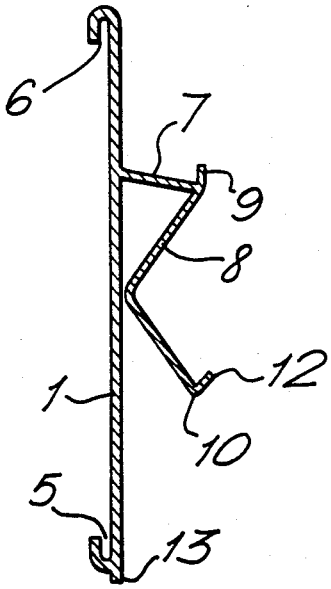

Further and preferred features of the invention are described by way of embodiments shown as examples in the accompanying drawings, wherein:

FIG. 1 shows a section through a ticket holder of a first embodiment,

FIG. 2 shows the ticket holder of FIG. 1 attached to a shelf ticket rail at one angle, FIG. 3 shows the ticket holder of FIG. 1 attached to a shelf ticket rail at another angle, FIG. 4 shows the ticket holder of FIG. 1 attached at yet another angle, FIG. 5 shows the ticket holder of FIG. 1 attached to a bin or basket, FIG. 6 shows a second embodiment having a more arcuate support surface, and FIG. 7 shows a third embodiment having a flat surface.

Referring to FIGS. 1 to 4 the ticket holder according to this invention comprises a support surface 1 forming the front with two opposed parallel sides 3 and 4 having respective channels 6 and 5 forming opposed slots into which a panel (not shown), carrying wording or pricing, may be inserted. The rear of the surface 1 has an extension 7 with a hook portion 8 defining a ticket rail engagement means. The hook portion has formations forming a first pair of opposed spaced parallel edges 9 and 10 of dimension A which may be flexed together so that the edges may engage the ticket rail 11 on a shelf edge (see FIG. 3).

Adjacent the edge 10 is a further edge 12 which, together with an edge 13 on the panel 1, forms a further pair of spaced parallel edges also of dimension A which may be engaged with the ticket rail 11, (see FIG. 2 and FIG. 4). In FIG. 4 the ticket holder is fitted in a position which is relatively inverted with respect to FIG. 2.

The arrangement thus provides for either a vertical (FIG. 3), an upward (FIG. 2) or downward (FIG. 4) inclined presentation for the surface 1, this being achieved by appropriate selection of the relative positioning of the edges 13,12 and 10,9.

The hook portion 8 also may be used to enable the holder to be attached to the top of a basket or bin 14 as shown in FIG. 5. The hook may also receive a rod or rail within the enlarged area 15.

The embodiments of FIGS. 6 and 7 are similar in function but have modified profile for the hook portion and support surface. As shown in FIG. 6 the surface 1 is more arcuate and the channels 6 and 5 are deeper.

Preferably the surface and hook are formed integrally and the whole may comprise a one piece extrusion of plastics material or metal which is then cut into appropriate lengths. Alternatively, the holder may be moulded in one piece.

The hook part 8 is made resilient whereby the dimension A is normally greater than that required to fit the rail 11 but may be reduced by compressing against the inherent resiliency, release then providing a restoring force to retain the ticket holder in the rail.

A further feature is illustrated in FIG. 5 wherein the edge of the panel having the channel 6 includes at the rear thereof a further channel 17 with a lip 18 which may be snapped-over a rod or rail 16 so as to support the ticket holder by such means.

I claim:

1. A ticket holder for shelving comprising a front support surface with parallel channels along opposed sides to receive a panel carrying pricing or other information, the rear of the holder having means for engagement with a ticket rail said means comprising integral formations defining a first pair of spaced parallel edges which can be relatively flexed to engage one within each of opposed parallel channels of a ticket rail, one of said edges being spaced with respect to a further formation at a side of the support surface so as to define therewith a further pair of spaced parallel edges which can be relatively flexed to engage the channels of a ticket rail, the support surface lying in one of two angled positions according to which pair of edges is engaged with the ticket rail.

2. A ticket holder as claimed in claim 1, wherein the engagement means comprises a hook shaped projection defining the first pair of edges, the hook lying adjacent the rear surface of the holder to form a clip.

3. A ticket holder for engagement with a shelf rail, the holder comprising a support surface with a front face thereof having parallel facing channels along opposed longitudinal sides the rear face having an integral longitudinal extension having a first part lying adjacent and converging with the rear surface of the holder to define a channel, and a second part extending therefrom and diverging from the rear surface to form an entrance slot to the channel, the said extension having a first pair of spaced parallel longitudinally extending edges of a dimension therebetween to engage said shelf rail, the extension having a further edge, which in conjunction with an edge of the holder defines a second pair of spaced longitudinally extending parallel edges of a dimension therebetween to engage said shelf ticket rail.

4. A ticket holder as claimed in claim 3, further including along the rear of the other edge of the holder a channel having an entrance slot for engagement with a rod or wire.

* * * * *